US005839244A

United States Patent [19]

Johnson et al.

[11] Patent Number: 5,839,244

[45] Date of Patent: Nov. 24, 1998

[54] VERTICAL STORM LOUVER SYSTEM

[75] Inventors: Paul A. Johnson; Gregg S. Holden; James P. Sullivan, all of Overland Park; Michael G. Wixson, Olathe, all of Kans.

[73] Assignee: Architectural Storm Louver,L.L.C., Lenexa, Kans.

[21] Appl. No.: 773,387

[22] Filed: Dec. 26, 1996

[51] Int. Cl.[6] ..... E06B 7/08

[52] U.S. Cl. ..... 52/473; 52/209; 454/224; 454/279

[58] Field of Search ..... 52/473, 209; 454/224, 454/277, 279, 309, 314, 315

[56] References Cited

U.S. PATENT DOCUMENTS

| | | | |
|---|---|---|---|
| 3,348,466 | 10/1967 | Lane et al. | 454/277 |
| 3,358,580 | 12/1967 | Freese et al. | 454/277 |
| 3,771,430 | 11/1973 | Lane | 52/473 |
| 3,953,183 | 4/1976 | Regehr . | |
| 4,691,487 | 9/1987 | Kessler | 52/209 |
| 4,852,312 | 8/1989 | Harbom | 52/209 |
| 5,542,224 | 8/1996 | Olsen | 52/473 |

*Primary Examiner*—Michael Safavi
*Attorney, Agent, or Firm*—Hovey,Williams, Timmons & Collins

[57] ABSTRACT

A storm louver (10, 12) having a plurality of spaced blades (16*a*, 16*b*, 16*c*, 16*d*) for removing water particles from air flowing into a building or air handling equipment is disclosed. Each louver (10, 12) has an improved blade support frame (18) that permits the blades (16*a*, 16*b*, 16*c*, 16*d*) to be more quickly and easily installed in the support frame (18) and that more firmly supports the blades. A modular louver system including at least two individual louvers that can be easily connected for installation in openings of any size is also disclosed.

12 Claims, 3 Drawing Sheets

VERTICAL STORM LOUVER SYSTEM

BACKGROUND OF THE INVENTION

1. FIELD OF THE INVENTION

The present invention relates to storm louvers having a plurality of spaced blades for removing water particles from air flowing into buildings or air handling equipment. More particularly, the invention relates to a louver having an improved support frame for supporting the blades. The invention also relates to a modular louver system having a plurality of individual louvers that can be easily connected and installed in openings of nearly any size.

2. DESCRIPTION OF THE PRIOR ART

Louvers for separating water and other particles from air flowing into buildings or air handling equipment are known in the art. Such prior art louvers typically include a plurality of curved, spaced blades that define a plurality of spaced, serpentine-shaped air passageways therebetween. The air passageways direct air from the exterior of the building or air handling equipment to the interior of the building or air handling equipment for air conditioning of the building.

When air passes into the building or air handling equipment through the air passageways, the water particles in the air, which are heavier than the gas molecules in the air, cannot turn through the serpentine-shaped contours in the air passageways. The water molecules therefore strike the walls of the blades, agglomerate into drops and flow by gravity down the blades and out of the louvers.

To achieve a consistent and desired water removal rate without excessively impeding the flow of air into the building or air handling equipment, the blades in the louvers must be spaced and supported in a uniform configuration. Known prior art louvers support their blades with rods that extend through holes formed in the tops and bottoms of the blades. The blades are spaced apart on the rods with spacers.

To assemble these types of louvers, the support rods are first inserted through the holes in the upper and lower edges of one of the blades. Spacers are then placed adjacent the blade, and another blade is placed on the rods adjacent the spacers so that the blades are spaced relative to one another. These steps are then repeated for each and every blade of the louver.

Unfortunately, these steps are time consuming because the blades and spacers must be individually and serially placed on the rods. These types of support assemblies are also somewhat flimsy because the holes formed in the blades must be large enough to allow the blades to slide over the rods. Thus, the blades tend to shift relative to one another on the rods when the louver is moved.

Another limitation of known prior art louvers is that they are assembled as single units regardless of the size of the openings they are mounted in. This is a problem when a louver must be installed in a large opening because the louver must be assembled with long support rods and a large number of blades to span the entire width of the opening, thus creating a finished louver that is extremely large and heavy.

A further limitation of known prior art louvers is that they do not include integral drainage assemblies for collecting and draining the water particles removed from the air. Prior art louvers must therefore be equipped with separate gutters or down spouts or other drainage systems for carrying the removed water away from the louver and out of the building or equipment.

OBJECTS AND SUMMARY OF THE INVENTION

In view of the foregoing, it is an object of the present invention to provide a louver having an improved blade support assembly.

It is a more particular object of the present invention to provide a louver with a blade support assembly that permits the blades to be more quickly and easily mounted within the support assembly and that more firmly supports the blades, resulting in an assembled louver that is strong and rigid.

It is another object of the present invention to provide a louver having an integral drainage system for collecting and draining water removed from the air away from the louver and out of the building or equipment.

It is a further object of the present invention to provide a louver system that can fit within nearly any size opening without creating individual louvers that are large, heavy and cumbersome to install.

The present invention achieves these objects and other objects that become evident from the description of the preferred embodiments of the invention herein by providing a louver with an improved blade support assembly and an integral draining system, and by providing a modular louver system that can be easily assembled to fit within openings of nearly any size.

The louver of the present invention broadly includes a plurality of elongated blades each having opposed lower and upper edges and a support frame for supporting the blades in a horizontally-spaced and vertically extending configuration so that the blades define therebetween a plurality of horizontally-spaced and vertically extending air passageways for the passage of air into a building or equipment. The preferred support frame includes a bottom frame member for receiving and supporting the lower edges of the blades and a top frame member for receiving and supporting the upper edges of the blades.

The preferred bottom frame member includes a pair of generally horizontally-extending ledges each including a plurality of horizontally-spaced slots formed therein and at least one horizontally-extending shelf spaced below one of the ledges. The blades are mounted in the support frame by inserting the lower edges of the blades through the slots in the ledges so that the blades rest on top of the shelf. This configuration permits the blades to be quickly and easily slid into the support frame and results in a louver that is substantially stronger and more rigid than prior art louvers.

The bottom frame member also includes a generally horizontally-extending base portion spaced below the ledges and shelf and having a plurality of drain holes formed therein. Water removed from the air by the blades is collected in the base portion and drained from the louver through the drain holes. The configuration creates an integral "drain pan" in each louver that collects and removes water from the louver independently of other louvers.

The present invention also includes connection structure for connecting two or more of the louvers together to form a single modular louver system. Any number of louvers may be connected to form a louver system of nearly any size for mounting within openings of nearly any size. In addition, the louvers employ an integral mullion member. This eliminates the need for separate mullion strips to be installed after the louvers are connected together to seal the joints between the two louvers.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
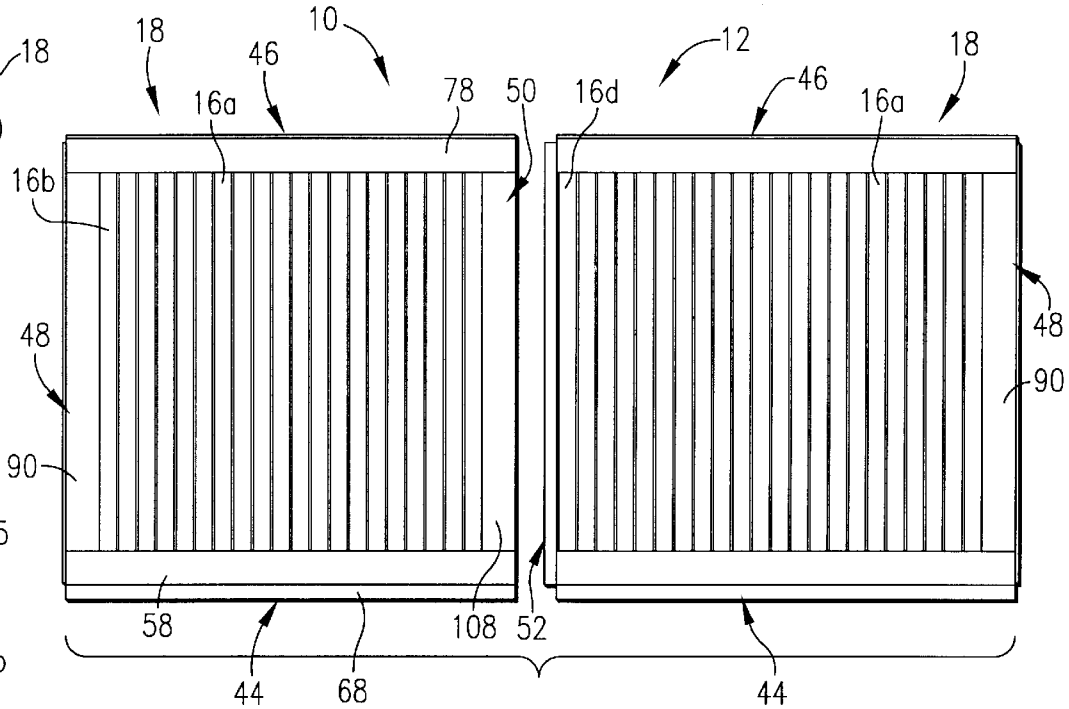
FIG. 1 is a front elevational view of a pair of louvers constructed in accordance with a preferred embodiment of the present invention showing the louvers separated to illustrate the connecting structure.
Figure 4:
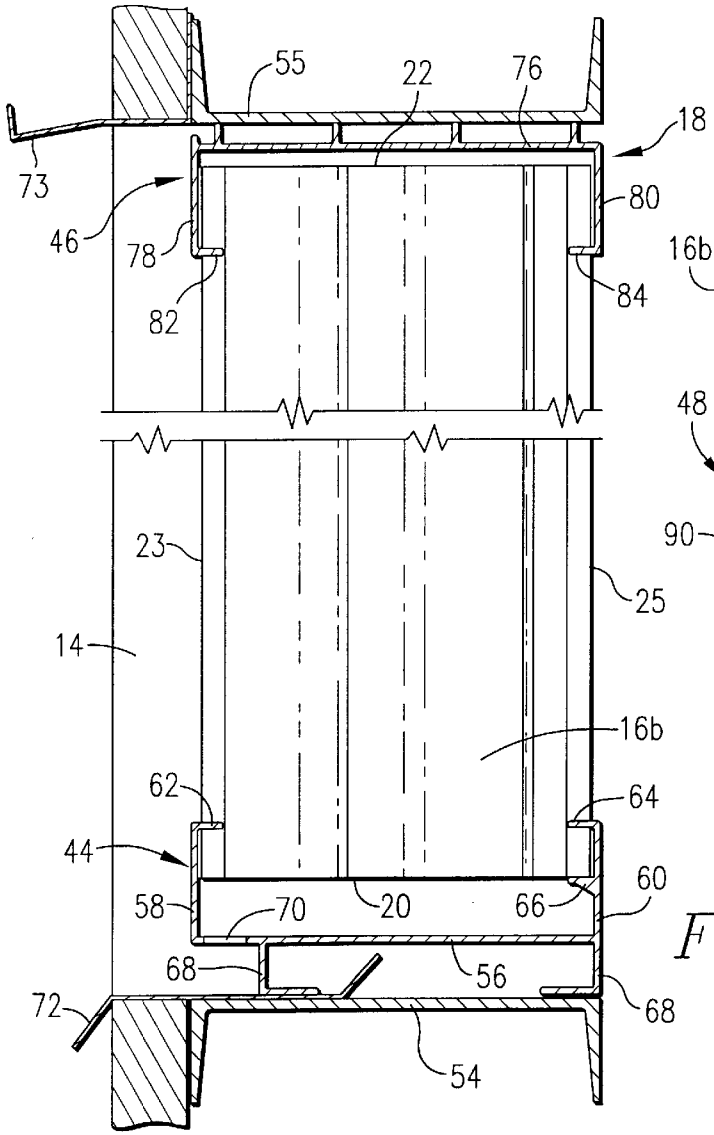
FIG. 4 is a side sectional view of the louvers taken along line 4—4 of FIG. 2.
Figure 2:
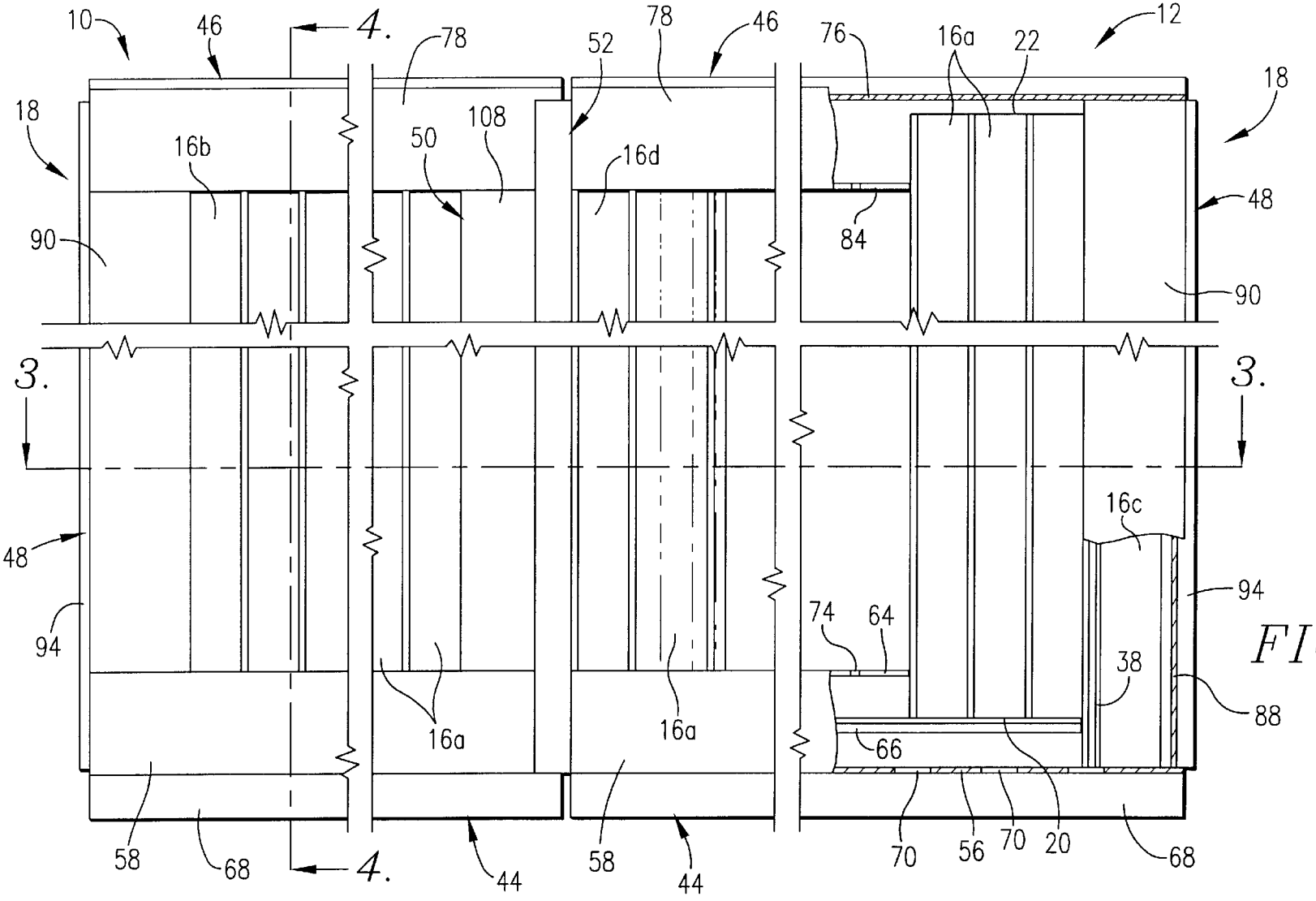
FIG. 2 is a fragmented front elevational view of the louvers with parts broken away.
Figure 3:
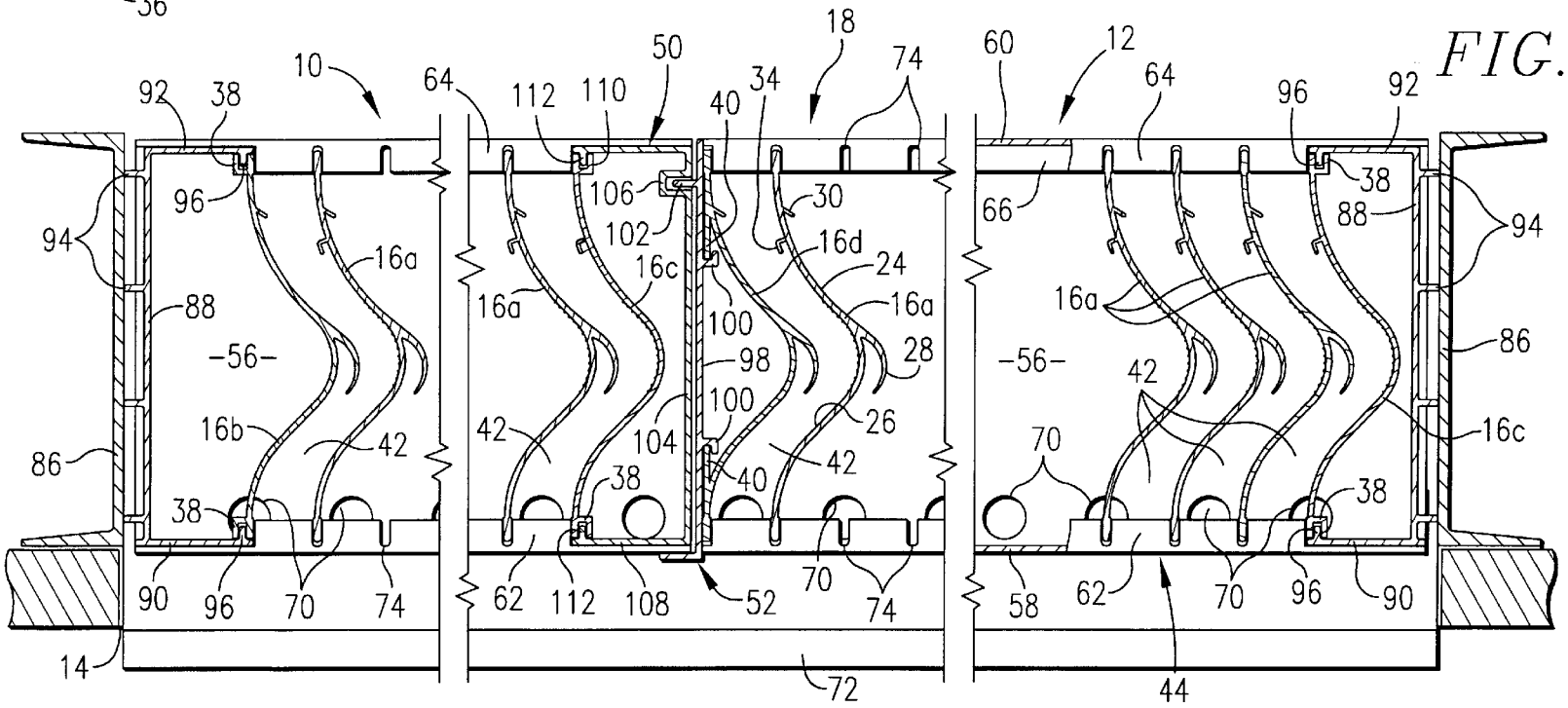
FIG. 3 is a top sectional view of the louvers taken along line 3—3 of FIG. 2.

Turning now to the drawing figures and particularly FIGS. 1 and 3, a pair of louvers 10,12 constructed in accordance with a preferred embodiment of the invention is illustrated. As illustrated in FIG. 4, the louvers 10,12 are configured for placement within or adjacent to an opening 14 in a building for permitting air to flow into the building while removing water particles from the air to prevent excess moisture from entering the building. Each louver 10,12 may be installed in the opening 14 individually or the louvers may be connected together or connected with additional louvers to form a multi-unit modular louver system discussed below.

Each louver 10,12 broadly includes a plurality of elongated blades 16*a*, 16*b*, 16*c*, 16*d* and a support frame generally referred to by the numeral 18 for supporting the blades in a horizontally-spaced and vertically extending configuration. The louvers 10,12 are substantially identical; therefore, their components are identified with the same numerals herein.

Figure 5:
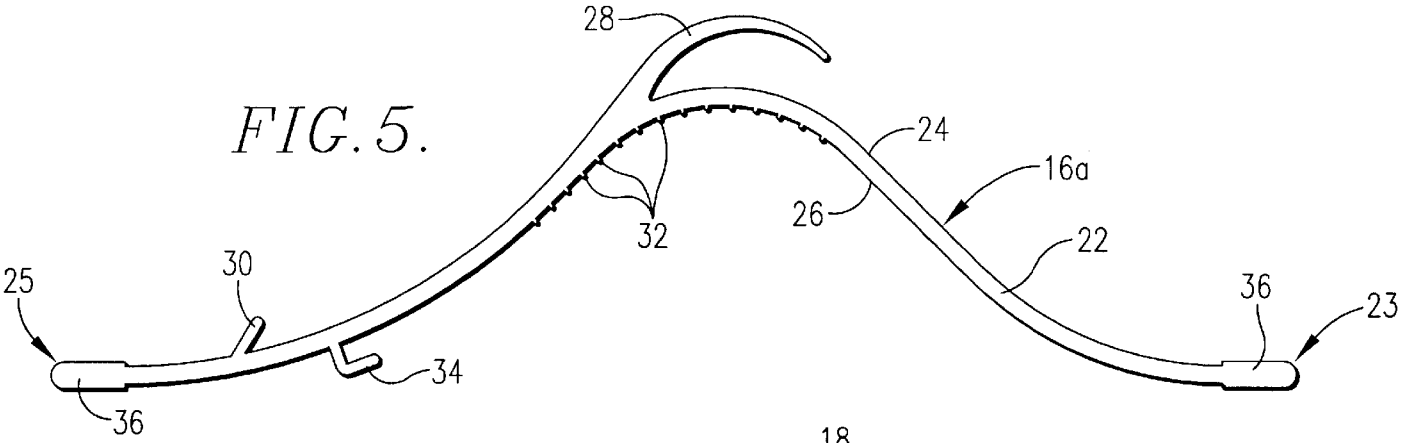
FIG. 5 is a plan view of one of the blades of the louvers.

The blades 16*a*, 16*b*, 16*c*, 16*d* are preferably formed from extruded aluminum and, as best illustrated in FIGS. 4 and 5, each presents a generally sine wave-shaped profile with opposed lower and upper edges 20,22, opposed front and rear edges 23,25, and opposed right and left vertically extending faces 24,26. The blades 16*a*, 16*b*, 16*c*, 16*d* are preferably approximately 6' in length and 6–120' in height, but may be formed in other sizes as a matter of design choice.

The blades 16*a* are positioned in the intermediate locations of the louvers 10,12 and each includes an arcuate hook 28 and an angled tab 30 extending from its right face 24 and a plurality of horizontally-spaced projections 32 and an L-shaped tab 34 extending outwardly from its left face 26 (see FIG. 5). Each blade 16*a* also includes a pair of slightly enlarged tabs 36 at its front and rear edges 23,25.

The blades 16*b* are positioned in the leftmost positions of each louver 10,12 when the louvers are installed individually. However, when two or more louvers are connected together as illustrated in FIG. 3, the blades 16*b* are positioned at the leftmost position of the left louver only. The blades 16*b* are similar to the blades 16*a* except that they do not include projections or a tab extending from their left faces 26. This is because the blades 16*b* do not have air passing along their left faces. Additionally, the front and rear edges 23,25 of each blade 16*b* include a generally U-shaped connection channel 38 rather than an enlarged tab.

The blades 16*c* are positioned in the rightmost positions of each louver 10,12 and are similar to the blades 16*a* except that they do not include a hook or tab extending from their right faces 24. This is because the blades 16*c* do not have air passing along their right faces. Additionally, the front and rear edges 23,25 of each blade 16*c* include a generally U-shaped connection channel 38 rather than an enlarged tab.

The blades 16*d* are only used when two or more louvers 10,12 are connected together as illustrated in FIG. 3. The blades 16*d* are positioned in the leftmost positions of all the connected louvers, except the leftmost louver. The blades 16*d* are similar to the blades 16*b* except that their front and rear edges 23,25 have enlarged tabs 36 rather than U-shaped connection channels, and they each further include a pair of walls 40 extending from their left faces.

The support frame 18 of each louver 10,12 supports its blades 16*a*, 16*b*, 16*c*, 16*d* in a horizontally-spaced and vertically extending configuration so that the blades define therebetween a plurality of horizontally-spaced and vertically extending air passageways 42 extending between the exterior and the interior of the building for directing air into the building. When air passes through the air passageways 42 and past the blades 16*a*, 16*b*, 16*c*, 16*d*, the hooks 28, tabs 30,34 projections 32, as well as the curved profile of the blades cooperate for removing water particles from the air. The removed water particles are then drained from the louver as described in more detail below.

When the louvers 10,12 are installed in the opening 14 individually, each support frame 18 includes a bottom frame member 44, a top frame member 46, and a pair of end frame members 48. However, when the louvers 10,12 are connected together or with additional louvers as illustrated in FIG. 3, the end frame member 48 on the right side of the louver 10 is replaced with a female-type end frame member 50, and the end frame member 48 on the left side of the louver 12 is replaced with a male-type end frame member 52.

The components of each support frame 18 are preferably formed of extruded aluminum, but may also be formed of other suitable materials. When assembled, each support frame 18 is preferably 48' wide, 48' high, and 6' deep.

The bottom frame member 44 of each louver 10,12 is preferably configured to rest on a support 54 mounted adjacent the lower edge of the inside face of the opening 14. As best illustrated in FIG. 4, the bottom frame member 44 includes a generally horizontally-extending base portion 56, a pair of generally vertically-extending front and rear walls 58,60 extending upwardly from the front and rear edges of the base portion 56, a pair of generally horizontally-extending ledges 62,64 extending inwardly from the top edges of the walls 58,60, at least one horizontally-extending shelf 66 spaced below the ledge 64, and a pair of generally L-shaped feet 68 depending from the lower face of the base portion 56.

As best illustrated in FIG. 3, the base portion 56 includes a plurality of spaced drain holes 70 formed therein adjacent its front edge. Water particles that are removed by the blades 16 accumulate on the top face of the base portion 56 and drain out of the louver 10,12 through the drain holes 70. The drain holes 70 are preferably approximately ⅝' in diameter and are spaced ½' from the front edge of the base portion 56.

As illustrated in FIG. 4, a strip of flashing 72 may be placed along the lower surface of the opening 14 and under the drain holes 70 to direct the drained water out of the louver 10,12 and away from the building. Another strip of flashing 73 may be placed along the upper surface of the opening to collect and direct rain and mist away from the louvers 10,12.

Returning to FIG. 3, the ledges 62,64 of the bottom frame member 44 each include a plurality of horizontally-spaced slots 74 formed therein for receiving and supporting the blades 16*a*. More particularly, the blades 16*a* are assembled in their support frame 18 by first aligning the front and rear edges 23,25 of each blade 16*a* between their respective slots 74 on the ledges 62,64. The enlarged tabs 36 on the blades

16*a* are then inserted through the slots 74 so that the rear edges 25 of the blades rest on top of the shelf 66. This configuration permits the blades 16*a* to be quickly and easily slid into the support frame and results in a louver that is substantially stronger and more rigid than prior art louvers. The slots 74 are preferably spaced 1' apart so that the air passageways 42 between the blades are approximately 1' in width.

As best illustrated in FIG. 4, the top frame member 46 is configured to fit beneath a support 55 mounted adjacent the upper edge of the inside face of the opening 14. The top frame member 46 preferably includes a generally horizontally-extending cover portion 76, a plurality of transversely extending reinforcement ribs 95 extending upwardly from the top face of the cover portion 76, a pair of vertically extending front and rear walls 78,80 extending downwardly from the front and rear edges of the cover portion, and a pair of generally horizontally-extending ledges 82,84 extending inwardly from the lower edges of the front and rear walls 78,80. The top edge of the front wall 78 extends slightly above the cover portion 76 to define an integral J-shaped channel 115 adjacent the forwardmost reinforcement rib 95. Caulking may be placed in the channel 115 for sealing the louver 10,12 in the opening 14.

The ledges 82,84 each include a plurality of horizontally-spaced slots formed therein that are in vertical alignment with the slots 74 in the ledges 62,64 of the bottom frame member 44. The slots receive and support the upper edges 22 of the blades 16*a* when the blades are inserted in their respective support frame 18.

The end frame members 48 are attached to the left and right sides of the top and bottom frame members 44,46, and are configured to slide between supports 86 mounted along the inside face of the left and right sides of the opening 14. When the louvers 10,12 are individually placed in the opening 14, each includes a pair of end frame members 48. However, when the louvers 10,12 are connected together or connected with additional louvers, only the outermost left and right sides of the combined louver system include end frame members 48 as illustrated in FIGS. 1 and 3.

Each end frame member 48 includes a vertically extending sidewall 88, a pair of transversely extending front and rear walls 90,92 extending inwardly from the sidewall, and a plurality of transversely extending reinforcement ribs 94 extending outwardly from the sidewall. The distal ends of the front and rear walls 90,92 each include an inwardly extending tab 96 for receiving and supporting the U-shaped connection channels 38 of the blades 16*b*, 16*c* as discussed below. The proximal ends of the front walls 90 each extend slightly beyond their sidewalls 88 to define an integral J-shaped channel 116 for accepting caulking.

The male-type end frame members 52 and female-type end frame members 50 are used when it is desired to connect two or more of the louvers 10,12 together. As best illustrated in FIG. 3, each male-type end frame member 52 includes a vertically extending sidewall 98, a pair of generally L-shaped tabs 100 extending from one face of the sidewall that each define a connection channel, and a transversely extending tab 102 projecting from the opposite face of the sidewall. In addition, an integral mullion member 102A is used to seal the joints between louvers 10,12.

Each female-type end frame member 50 includes a vertically extending sidewall 104 having an inwardly projecting female-type receptacle 106 therein, a pair of transversely extending front and rear end walls 108,110 and a pair of short connection tabs 112 extending inwardly from the distal ends of the front and rear end walls 108,110.

To connect two louvers 10,12 together, a male-type end frame member 52 is first connected to a blade 16*d* by sliding its L-shaped tabs 100 over the inwardly projecting walls 40 of the blade 16*d*. The male-type end frame member 52 and blade 16*d* are then welded, caulked or otherwise attached to the left side of the rightmost louver 12.

A female-type end frame member 50 is then connected to a blade 16*c* by sliding the U-shaped connection channels 38 on the front and rear edges of the blade 16*c* over the connection tabs 112 on the female-type end frame member. The female-type end frame member 50 and blade 16*c* are then welded, caulked, or otherwise attached to the right side of the leftmost louver 10.

The louvers 10,12 are then placed adjacent one another so that the tab 102 of the male-type end frame member 52 is received within the receptacle 106 of the female-type end frame member 50 so that the sidewalls 98,104 of the male-type and female-type end frame members are flush with one another. The male and female-type end frame members 50,52 are then attached by caulking or other attachment means. Those skilled in the art will appreciate that any number of louvers may be connected together in this fashion to form a modular louver system to fit within openings of nearly any size.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by letters patent includes the following:

1. A louver for placement in an opening for removing water particles from air flowing through the opening, said louver comprising:

a plurality of elongated blades each having opposed lower and upper edges; and a support frame for supporting said blades in a horizontally-spaced and vertically extending configuration so that said blades define therebetween a plurality of horizontally-spaced and vertically extending air passageways for the passage of air through the opening, said support frame including a bottom frame member supporting the lower edges of said blades and a top frame member supporting the upper edges of said blades, said bottom frame member including a generally horizontally-extending base portion, said base portion having a plurality of drain holes formed therein for draining the water particles removed from the air out of said louver, said bottom frame member further including a pair of front and rear wall sections extending upwardly from said base portion, the upper ends of said front and rear wall sections each including a generally horizontally-extending ledge, each of said ledges including a plurality of horizontally-spaced slots formed therein, the lower edges of said blades being received and supported in said slots.

2. The louver as set forth in claim 1, said bottom frame member further including a pair of generally L-shaped feet depending from said base portion for elevating said bottom frame member.

3. The louver as set forth in claim 2, said top frame member including a generally horizontally-extending cover portion, and a pair of front and rear wall sections depending from said cover portion, the lower ends of said front and rear wall sections each including a generally horizontally-extending ledge, each of said ledges including a plurality of horizontally-spaced slots formed therein, the upper edges of said blades being received and supported in said slots.

4. The louver as set forth in claim 1, said support frame further including a pair of end frame members extending between said top and bottom frame members.

5. The louver as set forth in claim 1, each of said blades having a generally sine wave shaped profile and a pair of opposed first and second vertically-extending faces, at least one of said blades including an arcuate hook extending from said first face and a plurality of spaced projections extending outwardly from said second face for capturing the water particles from the air as it passes through the air passageways and the opening.

6. A modular louver system for placement in an opening for removing water particles from air flowing through the opening, said louver system comprising:

at least two louvers each including a plurality of elongated blades having opposed lower and upper edges, and a support frame supporting said blades in a horizontally-spaced and vertically extending configuration so that said define therebetween a plurality of horizontally-spaced and vertically extending air passageways for the passage of air through the opening; and connecting structure for connecting said louvers together to form a single modular louver, said connecting structure including a first end frame member for attachment to the support frame of one of said louvers and a second, mating end frame member for attachment to the support frame of the other of said louvers, said first end frame member including a vertically-extending sidewall having an outwardly-projecting male-type tab, said second end frame member including a vertically-extending sidewall having an inwardly-projecting female-type receptacle for receiving the tab of said first end frame member when said louvers are placed adjacent one another so that the sidewalls of said first and second end frame members are flush with one another.

7. The louver system as set forth in claim 6, said support frame of each of said louvers including a bottom frame member supporting the lower edges of its blades and a top frame member supporting the upper edges of its blades.

8. The louver system as set forth in claim 7, each of said bottom frame members including a generally horizontally-extending base portion, said base portion having a plurality of drain holes formed therein for draining the water particles removed from the air out of said louver.

9. The louver system as set forth in claim 8, each of said bottom frame members further including a pair of front and rear wall sections extending upwardly from said base portion, the upper ends of said front and rear wall sections each including a generally horizontally-extending ledge, each of said ledges including a plurality of horizontally-spaced slots formed therein, the lower edges of said blades being received and supported in said slots.

10. The louver system as set forth in claim 7, each of said top frame members including— a generally horizontally-extending cover portion, and a pair of front and rear wall sections depending from said base portion, the lower ends of said front and rear wall sections each including a generally horizontally-extending ledge, each of said ledges including a plurality of horizontally-spaced slots formed therein, the upper edges of said blades being received and supported in said slots.

11. The louver system as set forth in claim 7, said support frame of each of said louvers further including a pair of end frame members extending between its top and bottom frame members.

12. The louver system as set forth in claim 6, said first end frame member further including an integral mullion for sealing said first and second end frame members.

* * * * *